US011792899B2

(12) United States Patent
Jiang

(10) Patent No.: US 11,792,899 B2
(45) Date of Patent: Oct. 17, 2023

(54) METHOD AND SYSTEM FOR FIXING INITIAL BRIGHTNESS LEVEL OF LIGHT FIXTURE, AND LIGHT FIXTURE SYSTEM

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 74 days.

(21) Appl. No.: 17/588,766

(22) Filed: Jan. 31, 2022

(65) Prior Publication Data

US 2023/0094791 A1 Mar. 30, 2023

(30) Foreign Application Priority Data

Sep. 29, 2021 (CN) ..... 202111153397.4

(51) Int. Cl.
*H05B 45/10* (2020.01)
*H05B 45/325* (2020.01)

(52) U.S. Cl.
CPC ..... *H05B 45/10* (2020.01); *H05B 45/325* (2020.01)

(58) Field of Classification Search
CPC ..... G09G 2320/0646; G09G 3/3406; G09G 2320/064; G09G 2360/16; G09G 2330/021; G09G 2360/144; G09G 2360/145; G09G 3/3426; G09G 2320/0233; G09G 2320/0261; G09G 2320/0271; G09G 2320/062; G09G 3/32; G09G 3/342; G09G 2320/0626; G09G 2320/0673; G09G 3/3233; G09G 3/3611; G09G 3/3648; G09G 5/10; G09G 2310/024; G09G 2320/066; G09G 2310/08; G09G 2320/0285; G09G 2320/041; G09G 3/22; G09G 2310/0237; G09G 2310/0291; G09G 2320/0242; G09G 2320/043; G09G 2340/16; G09G 3/2014; G09G 2320/0276; G09G 2320/0606; G09G 2320/0666; G09G 2320/0686; G09G 2320/103; G09G 2320/106;

(Continued)

(56) References Cited

U.S. PATENT DOCUMENTS

2007/0188438 A1* 8/2007 Fletcher ..... G09G 3/3406 345/102
2014/0128941 A1* 5/2014 Williams ..... A61N 5/06 315/193

(Continued)

*Primary Examiner* — Monica C King
(74) *Attorney, Agent, or Firm* — Muncy, Geissler, Olds & Lowe, P.C.

(57) ABSTRACT

A method for fixing an initial brightness level of lights is provided. Gamma correction is performed on the light based on a dynamic Gamma curve. When a user adjusts brightness of the light based on the dynamic Gamma curve, a dynamic Gamma curve image is valid all the time when a set current brightness level n changes from 0 to N, and when x>0, the dynamic Gamma curve image is continuous, and accordingly, brightness of the light continuously changes gradually. Further, by calculating an initial brightness PWM critical duty ratio D of light sources, the dynamic Gamma curve is customized according to the light, so that an initial brightness level position of the light sources in the same model is fixed and unified.

11 Claims, 4 Drawing Sheets

(58) Field of Classification Search
CPC .... G09G 2330/10; G09G 3/14; G09G 3/2011; G09G 3/2018; G09G 2300/0814; G09G 2310/0232; G09G 2310/0235; G09G 2310/0207; G09G 2310/061; G09G 2320/0252; G09G 2320/0613; G09G 2330/028; G09G 2340/0435; G09G 2370/04; G09G 2370/10; G09G 3/006; G09G 3/20; G09G 3/2007; G09G 3/2092; G09G 3/2096; G09G 3/3413; G09G 3/36; G09G 3/3614; G09G 3/3688; G09G 5/006; G09G 2300/0426; G09G 2310/0283; G09G 2310/0289; G09G 2320/0209; G09G 2320/0633; G09G 2320/0653; G09G 2320/0693; G09G 2330/023; G09G 2330/026; G09G 2330/12; G09G 2340/0464; G09G 2340/125; G09G 2340/14; G09G 2360/18; G09G 2370/02; G09G 2370/042; G09G 2370/045; G09G 2370/08; G09G 3/003; G09G 3/2003; G09G 3/2022; G09G 3/2025; G09G 3/2085; G09G 3/3666; G09G 3/367; G09G 3/3696; G09G 5/36; G09G 2300/02; G09G 2300/026; G09G 2300/043; G09G 2300/08; G09G 2300/0857; G09G 2300/0861; G09G 2310/0275; G09G 2310/06; G09G 2320/0204; G09G 2320/028; G09G 2320/045; G09G 2320/046; G09G 2330/06; G09G 2340/0407; G09G 2350/00; G09G 2360/08; G09G 2360/121; G09G 2370/022; G09G 2370/16; G09G 2370/18; G09G 2370/20; G09G 3/001; G09G 3/02; G09G 3/3208; G09G 3/3241; G09G 3/3258; G09G 3/3607; G09G 5/001; G09G 5/005; G09G 5/02; G09G 5/026; G09G 5/363; G09G 5/37; H05B 45/325; H05B 45/00; H05B 43/3725; H05B 45/20; H05B 45/24; H05B 45/36; H05B 45/46; H05B 47/155; H05B 47/10; H05B 44/00; H05B 45/12; H05B 45/22; H05B 45/355; H05B 45/37; H05B 45/385; H05B 45/395; H05B 45/56; H05B 47/18; H05B 41/2828; H05B 45/33; H05B 45/375; H05B 45/38; H05B 45/39; H05B 45/397; H05B 47/11; H05B 47/175; H05B 45/10; F21K 9/68; G02F 1/133601; G02F 1/133603; G02F 2203/30; Y02B 20/00; Y02B 20/30; Y02B 20/40
See application file for complete search history.

(56) References Cited

U.S. PATENT DOCUMENTS

| | | | | |
|---|---|---|---|---|
| 2022/0044643 | A1* | 2/2022 | Gu | G09G 3/32 |
| 2022/0191989 | A1* | 6/2022 | Williams | H05B 45/46 |
| 2023/0094791 | A1* | 3/2023 | Jiang | H05B 47/10 315/291 |

* cited by examiner

METHOD AND SYSTEM FOR FIXING INITIAL BRIGHTNESS LEVEL OF LIGHT FIXTURE, AND LIGHT FIXTURE SYSTEM

CROSS REFERENCE TO RELATED APPLICATIONS

The present application claims priority from Chinese Patent Application No. 202111153397.4 filed on Sep. 29, 2021, all of which are hereby incorporated herein by reference.

TECHNICAL FIELD

The present invention relates to the technical field of lighting brightness adjusting and, more particularly, relates to a method and system for fixing initial brightness level of a light fixture, and a light fixture system.

BACKGROUND

The perception of human eyes on brightness is not simply a linear relationship. Accordingly, the linear changing relationship between the brightness of a light source and the physical power is not linear in the human eyes, but changeable. The brightness change of the light source is required to be adjusted to conform to the linear change process of the human eye's perception on the brightness, which is referred to Gamma correction, and function image thereof is referred to Gamma curve.

The light source is usually set a brightness level according to current, a user thus can adjust the current flowing through the light source and adjust the brightness of the light source according to the set brightness level. It is generally considered that the brightness level at which the light source emits light initially is made to be an initial brightness level.

An LED light source in the prior art is a semiconductor. Being affected by a semiconductor material and a manufacturing process, when the driving current of the LED light source is lower than a threshold current, it will not emit light. FIG. 1 is a graph showing the relationship between current and brightness of the LED light source in the prior art, showing that the LED light source does not emit light when the current is lower than 0.1 A. This causes that the user needs to adjust the brightness level to be larger, such as level 20, when adjusting brightness, the light source then starts to emit light. When multiple light fixtures provided with light sources in different models are used at the same time, the initial brightness level of these light sources is more uncertain, so that such light sources will not light up simultaneously, for embodiment some light sources emit light early, while some light sources emit light late, resulting uneven brightness of the lights, which affects use of the multiple light fixtures.

In the LED lighting industry, PWM signals are usually used to control the brightness change of the LED light source. Specifically, by changing the PWM duty ratio, the current flowing through the LED light source is changed, so that the brightness of the LED light source is gradually changed.

The Gamma curve can also represent the corresponding relationship between the brightness level of the light source and the PWM duty ratio. During a stage performance, it is usually necessary to record video or live broadcast, in order to prevent the lighting picture captured by the video recorder from flickering, the refresh rate of the light fixture is required to be set to a value matched with the video recorder.

The refresh rate is the frequency, and is the reciprocal of the period. The higher the refresh rate is, the smaller the period will be. When the refresh rate is changed, the initial brightness level will also change accordingly. For embodiment, when a refresh rate of a light fixture is 2.4 kHz, the corresponding initial brightness level is level 20, however, when the refresh rate is increased to 16 kHz, the period T becomes smaller, but the Gamma curve remains unchanged, and the PWM duty ratio D is unchanged when the corresponding brightness level on the Gamma curve is level 20. According to the effective action time t=D×T of the current, if the period T becomes smaller, the duty ratio D remains unchanged, which results in that the effective action time t of the current becomes smaller, and the obtained corresponding current effective value also becomes smaller, at this moment, the light fixture will not emit light. Therefore, the brightness level needs to be increased to make the light fixture emit light, that is, the initial brightness level of the light fixture becomes larger.

The above-mentioned factors result in that the initial brightness level of the light fixture is uncertain and uneven, brightness adjusting of the light fixture is difficult, causing poor use effect.

SUMMARY

In view of the above-mentioned factors, the present invention aims to provide a method and system for fixing an initial brightness level of a light fixture, a storage medium and a light system, which can solve the technical problems of uncertain initial brightness level of light fixtures and consequently difficult brightness adjusting of the light fixture.

According to the present invention, a method for fixing an initial brightness level of a light fixture is provided, Gamma correction is performed on the light fixture based on a dynamic Gamma curve;

the dynamic Gamma curve is as follows:

$$G(x) = \begin{cases} 0 & (x = 0) \\ (1-b)x^{\gamma} + b & (0 < x \le i,\ 0 < b < 1) \end{cases};$$

wherein, G(x) is the dynamic Gamma curve, x=n/N, n is a current brightness level set by a user, N is a maximum brightness level of the light fixture, γ is a current Gamma value set by the user, and b is a current initial brightness PWM threshold.

According to the present invention, when the user adjusts brightness of the light fixture based on the above-mentioned dynamic Gamma curve, the dynamic Gamma curve image is all valid when the set current brightness level n changes from 0 to N, and when x=0, the light fixture remains off, and when x>0, accordingly, brightness of the light fixture continuously changes gradually.

The current initial brightness PWM threshold b is specifically as follows:

$$b = G_0(x) \cdot \frac{f}{f_0}\ (0 \le x \le 1);$$

wherein, $G_0(x)$ is a function of an original Gamma curve of the light fixture, $x=n_0/N$, $n_0$ is an original initial brightness level of the light fixture, N is the maximum brightness level of the light fixture, $f_0$ is an original refresh rate when the light fixture adopts the original Gamma curve $G_0(x)$, and f is a current refresh rate set by the user.

The function of the original Gamma curve of the light fixture is set to be $G_0(x)=x^{\gamma_0}$, $(0 \le x \le 1)$, wherein $\gamma_0$ is an original Gamma value set by the user.

The original Gamma value $\gamma_0$ ranges from 2.0 to 2.4.

The original initial brightness level $n_0$ and the original refresh rate $f_0$ of the light fixture are acquired by the following method:

setting the Gamma curve of the light fixture as the original Gamma curve $G_0(x)$, adjusting the light fixture of which the Gamma curve is the original Gamma curve to an initial brightness state;

acquiring the original refresh rate $f_0$ of the light fixture with the original Gamma curve in the initial brightness state;

acquiring the original initial brightness level $n_0$ of the light fixture with the original Gamma curve in the initial brightness state.

The method of acquiring the original initial brightness level $n_0$ of the light fixture specifically comprises:

respectively setting each Gamma curve of A sets of light fixtures in the same model as the original Gamma curve $G_0(x)$;

respectively adjusting A sets of light fixtures of which the Gamma curve is the original Gamma curve to the initial brightness state, and acquiring an experimental initial brightness level $n_a$ of each light fixture in the initial brightness state, wherein A is ≥2, which is a positive integer;

wherein the original initial brightness level $n_0$ is a maximum value of the acquired A sets of experimental initial brightness levels $n_a$.

According to the present invention, before adjusting the light fixture of which the Gamma curve is the original Gamma curve to the initial brightness state, the method further comprises:

placing the light fixture in a dark room.

The current Gamma value $\gamma$ ranges from 2.0 to 2.4.

According to a second aspect of the present invention, a system for fixing an initial brightness level of a light fixture is provided and comprises:

an adjusting module for performing Gamma correction on the light fixture based on a dynamic Gamma curve, the dynamic Gamma curve is as follows:

$$G(x) = \begin{cases} 0 & (x = 0) \\ (1-b)x^{\gamma} + b & (0 < x \le 1,\ 0 < b < 1) \end{cases};$$

wherein, G(x) is the dynamic Gamma curve, x=n/N, n is a current brightness level set by a user, N is a maximum brightness level of the light fixture, $\gamma$ is a current Gamma value set by the user, and b is a current initial brightness PWM threshold.

According to a third aspect of the present invention, a computer-readable storage medium is provided, a computer program is stored on the computer-readable storage medium, and when the computer program is executed by a processor, the method for fixing the initial brightness level of the light fixture is implemented.

According to a fourth aspect of the present invention, a light fixture system is provided, comprising a light source and a control unit connected to each other, and the dynamic Gamma curve mentioned above is pre-set in the control unit.

The control unit is configured to receive a current brightness level input by a user, and outputs a current PWM duty ratio corresponding to the current brightness level to the light source according to the dynamic Gamma curve, so that the light source emits light according to the current PWM duty ratio.

Compared with the prior art, the present invention has the beneficial effects that:

(1) an LED light source in the prior art does not emit light when its driving current is lower than a threshold current, resulting in uncertainty in an initial brightness level position when adjusting brightness, which affects the brightness adjusting effect. By taking into account the current initial brightness PWM threshold of the light source, the present invention customizes the dynamic Gamma curve according to the light fixture, so that the initial brightness level position of the light sources in the same model is fixed and unified:

(2) according to the LED light source in the prior art, Gamma correction is performed based on the original Gamma curve $y=x^{\gamma}$, and when the current Gamma value $\gamma$ is changed or a different current refresh rate f is set, it also results in an uncertainty in a initial brightness level position when adjusting brightness. The present invention can automatically generate the dynamic Gamma curve based on the current Gamma value $\gamma$ and any current refresh rate f, and then perform Gamma correction on the light source via the generated dynamic Gamma curve so as to fix and unify the initial brightness level position of the light source. The user can freely configure the current Gamma value $\gamma$ and any current refresh rate f according to the use scenario.

DETAILED DESCRIPTION

The accompanying drawings are only for illustrative descriptions and cannot be understood as a limitation to the patent. In order to better illustrate the following embodiments, some parts of the accompanying drawings may be omitted, enlarged or reduced, and do not represent a size of an actual product; and it is understandable for those skilled in the art that some well-known structures in the accompanying drawings and their descriptions may be omitted.

Embodiment 1

A method for fixing an initial brightness level of a light fixture, in which Gamma correction is performed on the light fixture based on a dynamic Gamma curve, the dynamic Gamma curve is as follows:

$$G(x) = \begin{cases} 0 & (x = 0) \\ (1-b)x^{\gamma} + b & (0 < x \le 1,\ 0 < b < 1) \end{cases};$$

wherein, G(x) is a Gamma curve, x=n/N, n is a current brightness level set by a user, N is a maximum brightness level of the light fixture, $\gamma$ is a current Gamma value set by the user, and b is a current initial brightness PWM threshold, n and N are both positive integers.

In order to fix the initial brightness level of the light fixture, the Gamma curve of the light fixture can be set to the dynamic Gamma curve according to the present embodiment. Gamma correction is performed on the light fixture based on the dynamic Gamma curve of the present embodiment.

Figure 1:
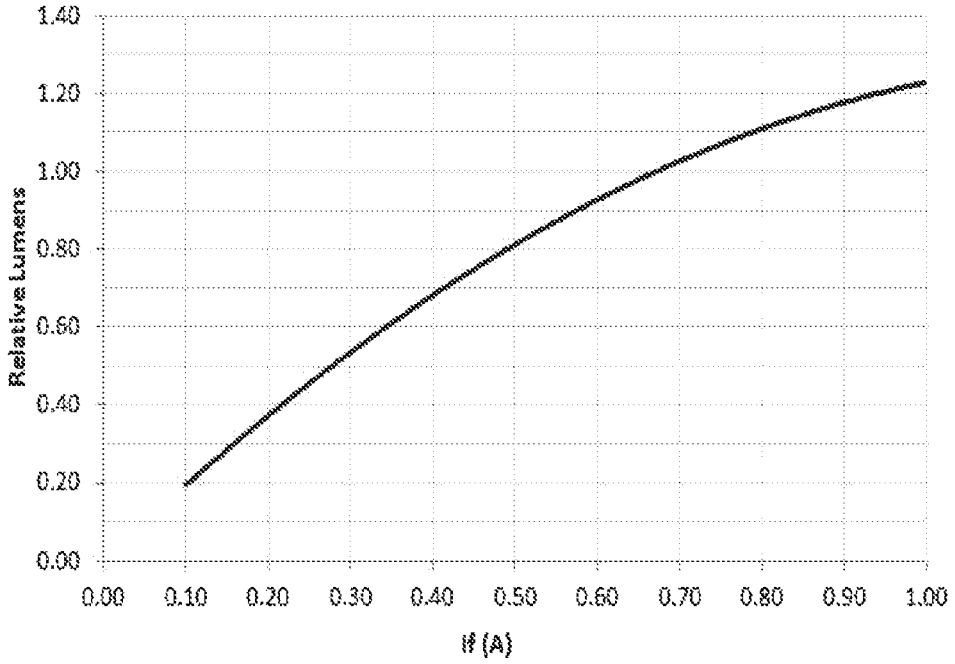
FIG. 1 is a graph showing the relationship between current and brightness of an LED light source in the prior art.
Figure 2:
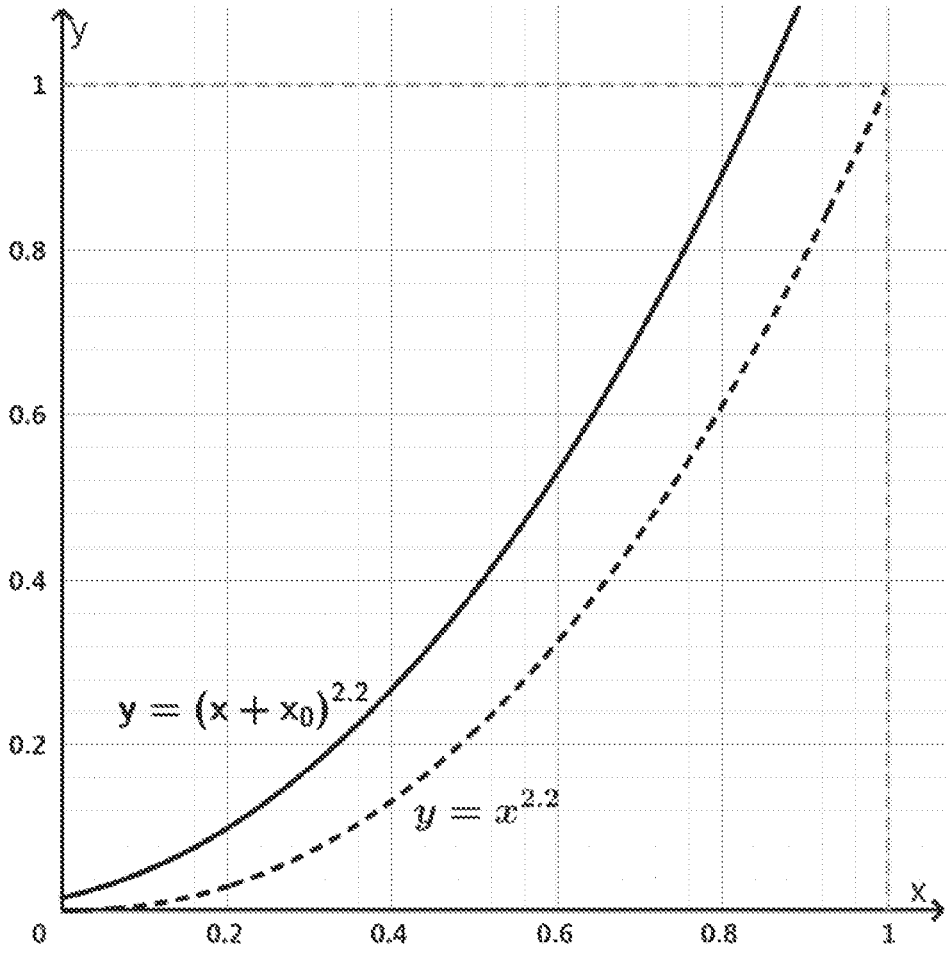
FIG. 2 is a schematic diagram of a left-shifted Gamma curve according to the present invention.

The dynamic Gamma curve of the present embodiment is transformed from an original Gamma curve. Specifically, a dotted line in FIG. 2 is a 2.2Gamma curve $y=x^{2.2}$ in the prior art, passing through an origin (0, 0) and (1, 1). An x axis represents normalization of the brightness level of the light fixture, referred to x=n/N, where N is the maximum brightness level of the light fixture, n is the current brightness level set by the user, $0\leq n\leq N$, so $0\leq x\leq 1$. A y axis represents a PWM duty ratio, $0\leq y\leq 1$, and the greater the PWM duty ratio, the higher the brightness of the light fixture.

It can be understood that in order to achieve continuous adjustment of brightness of the light fixture, the Gamma curve is required to be continuous when $0\leq x\leq 1$, and $0\leq y\leq 1$. Simultaneously, in order to solve the problem that the light fixture does not emit light until an input current of the light fixture reaches a threshold current, the transformed Gamma curve should intersect with a positive half axis of the y axis with an intercept of b (b>0), which is the current initial brightness PWM threshold. The transformed Gamma curve passes through a point (0, b).

Figure 3:
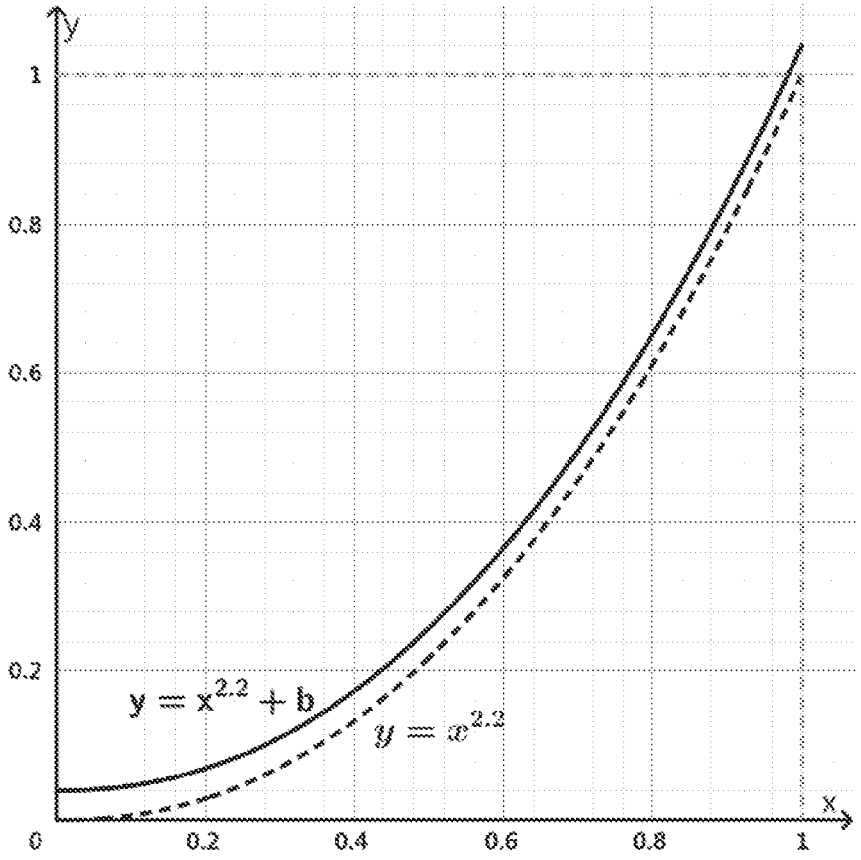
FIG. 3 is a schematic diagram of an upward-shifted Gamma curve according to the present invention.

As shown in FIG. 2 and FIG. 3, if the 2.2Gamma curve $y=x^{2.2}$ in the prior art (as shown by dashed lines in FIG. 2 and FIG. 3) is directly translated leftwards by $x_0$ or upwards by b, $y=(x+x_0)^{2.2}$ (as shown by a solid line in FIG. 2) or $y=x^{2.2}+b$ (as shown by a solid line in FIG. 3) is obtained. Although it is possible to make the Gamma curve intersect with the positive half axis of the y axis, the directly translated and transformed Gamma curve does not pass through a point (1, 1), its image would go beyond a range of $0\leq x\leq 1$, and $0\leq y\leq 1$, so that a brightness adjusting requirement of the light fixture when x is large cannot be met. Therefore, after translated, the Gamma curve is also needed to be aligned for stretching transformation to make the image of the Gamma curve not beyond the range of $0\leq x\leq 1$, and $0\leq y\leq 1$.

Figure 4:
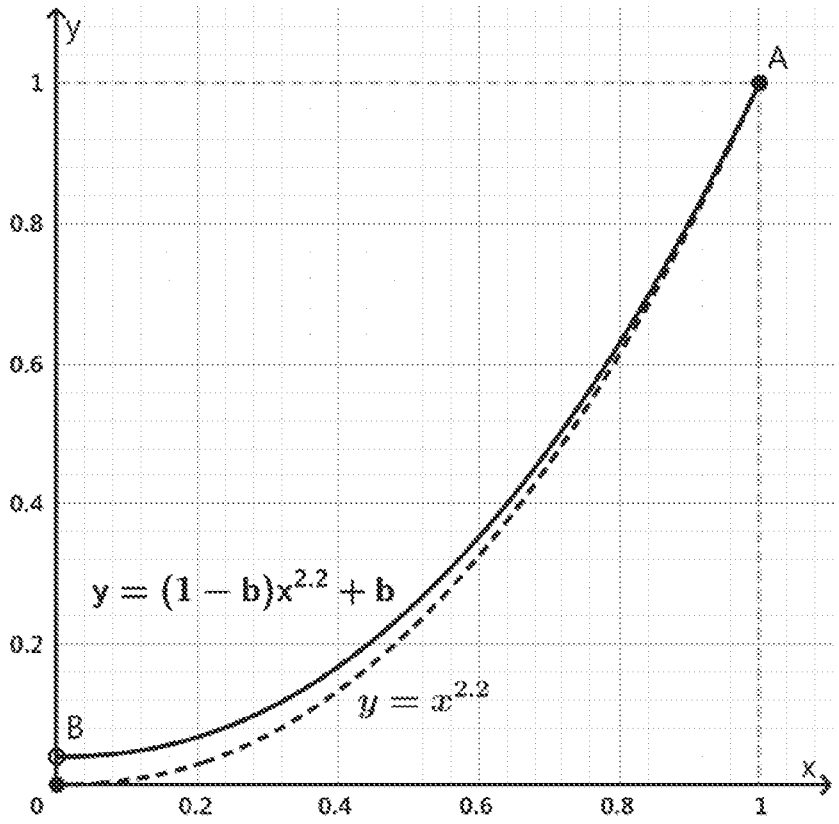
FIG. 4 is a schematic diagram of a dynamic Gamma curve according to the present invention.

As shown in FIG. 4, according to a preferred embodiment, according to that the image of the transformed Gamma curve needs to always pass through the point (1, 1) and the point (0, b), and the dynamic Gamma curve obtained after transformation (as shown by a solid line in FIG. 4) is:

$$G(x)=\begin{cases}0 & (x=0)\\ (1-b)x^{\gamma}+b & (0<x\leq 1,\ 0<b<1)\end{cases};$$

wherein $\gamma$ is a current Gamma value set by the user.

When x=0, G(x)=0, its physical meaning is that when the current brightness level n set by the user is 0, that is, when x=0, the PWM duty ratio is 0, and the light fixture does not emit light.

Based on the above-mentioned dynamic Gamma curve, when the user adjusts brightness of the light fixture, a dynamic Gamma curve image is valid all the time when the set current brightness level n changes from 0 to N, and when x>0, the dynamic Gamma curve image is continuous, and accordingly, the brightness of the light fixture continuously changes gradually.

The current initial brightness PWM threshold b according to an embodiment is specifically as follows:

$$b=G_0(x)\cdot\frac{f}{f_0}\ (0\leq x\leq 1);$$

wherein, $G_0(x)$ is a function of an original Gamma curve of the light fixture, $x=n_0/N$, no is an original initial brightness level of the light fixture, N is the maximum brightness level of the light fixture, $f_0$ is an original refresh rate when the light fixture adopts the original Gamma curve $G_0(x)$, and f is a current refresh rate set by the user.

The current initial brightness PWM threshold b will change with a change of the current refresh rate f set by the user, and at the same time, the original initial brightness level $n_0$, the maximum brightness level N and the original refresh rate $f_0$ will be different for light fixtures in different models. Therefore, the Gamma curve obtained based on transformation of the current initial brightness PWM threshold b is the dynamic Gamma curve, the dynamic Gamma curve can adapt to the light fixtures in different models and can be customized according to different light fixtures, and the initial brightness level of the same light fixture is fixed and unchanged under any current refresh rate f.

The function of the original Gamma curve of the light fixture is set to be $G_0(x)=x^{\gamma_0}$, $(0\leq x\leq 1)$, wherein $\gamma_0$ is an original Gamma value set by the user.

In combination with the function of the original Gamma curve, it can be obtained:

$$b=\left(\frac{n_0}{N}\right)^{\gamma_0}\cdot\frac{f}{f_0};$$

wherein $n_0$ is the original initial brightness level of the light fixture, N is the maximum brightness level of the light fixture, $f_0$ is the original refresh rate when the light fixture adopts the original Gamma curve $G_0(x)$, f is the current refresh rate set by the user, and $\gamma_0$ is the original Gamma value set by the user.

A derivation process of the dynamic Gamma curve is described as follows.

For the light fixture of which the Gamma curve is the original Gamma curve, in an initial brightness state (namely, the brightness level is the original initial brightness level $n_0$), and the refresh rate is the original refresh rate $f_0$, $x=n_0/N$ is substituted into the original Gamma curve $G_0=x^{\gamma_0}(0\leq x\leq 1)$ an original critical duty ratio $D_0$ when the light fixture is at the initial brightness level is thus acquired:

$$D_0=G\left(\frac{n_0}{N}\right)=\left(\frac{n_0}{N}\right)^{\gamma_0};$$

the original critical duty ratio $D_0$ is a PWM duty ratio when the light fixture of which the Gamma curve is the original Gamma curve starts to emit light.

The reason that the initial brightness level of the light fixture changes with the refresh rate is a change of effective action time t of the current. Therefore, the initial brightness level can be fixed merely by fixing the effective action time t of the current when the light fixture starts to emit light under any current refresh rate f.

In order to fix the effective action time t of the current, let $t=D_0T_0=DT$, wherein, $T=1/f$, $T_0=1/f_0$, in combination with a relational expression of the original critical duty ratio $D_0$, it is obtained by substitution that:

$$\left(\frac{n_0}{N}\right)^{\gamma_0}\cdot\frac{1}{f_0}=D\frac{1}{f};$$

the critical duty ratio D of the light fixture at the initial brightness level under any current refresh rate f is obtained:

$$D=\left(\frac{n_0}{N}\right)^{\gamma_0}\cdot\frac{f}{f_0};$$

the critical duty ratio D is the PWM duty ratio when the light fixture starts to emit light under any current refresh rate f.

It can be seen from the above equation that the critical duty ratio D of the light fixture changes with the current refresh rate f.

It can be understood that if a fixed Gamma curve is used, then if the critical duty ratio D (y-axis coordinate) changes, an x-axis coordinate corresponding to the critical duty ratio D will also change, and according to x=n/N, the initial brightness level n will also change, resulting in uncertainty of the initial brightness level n under different refresh rates.

The current initial brightness PWM threshold b is set as the critical duty ratio D, the dynamic Gamma curve which changes dynamically with the change of the current refresh rate f is obtained, the dynamic Gamma curve image passes through a point (0, D), and the physical meaning of the point is that, for the light fixture under any refresh rate, as long as the brightness level is adjusted as the initial brightness level, the critical duty ratio D can be reached, so that the light fixture can emit light, achieving effect of fixing the initial brightness level.

In order to achieve that the light fixture does not emit light when x=0 for the Gamma, the dynamic Gamma curve is sub-sectioned when x=0, and the obtained final dynamic Gamma curve is:

$$G(x)=\begin{cases}0 & (x=0)\\ \left(1-\left(\frac{n_0}{N}\right)^{\gamma_0}\cdot\frac{f}{f_0}\right)x^{\gamma}+\left(\frac{n_0}{N}\right)^{\gamma_0}\cdot\frac{f}{f_0} & (0<x\le 1)\end{cases};$$

wherein, G(x) is the Gamma curve, x=n/N, n is the current brightness level set by the user, N is the maximum brightness level of the light fixture, $\gamma$ is the current Gamma value set by the user, $\gamma_0$ is the original Gamma value set by the user, f is the current refresh rate set by the user, $n_0$ is the original initial brightness level of the light fixture, $f_0$ is the original refresh rate of the light fixture, and n, $n_0$ and N are all positive integers.

The current Gamma value $\gamma$ and the current refresh rate f can be set by the user according to the current usage scenario.

Gamma correction is performed on the light fixture based on the above-mentioned dynamic Gamma curve such that a controller for controlling the brightness of the light fixture receives the current brightness level n input by the user, and outputs a corresponding PWM duty ratio to a driver according to the dynamic Gamma curve, so that the driver controls the brightness of the light fixture according to the corresponding PWM duty ratio.

For the light fixture under any set current refresh rate f, the light fixture is turned off at a brightness level 0 and starts to emit light at a brightness level 1. When the brightness level is adjusted from the 1st level to the Nth level, the light fixture emits light all the time without a loss of the brightness level. By arbitrarily changing the current refresh rate f, a position of the initial brightness level can still be dynamically maintained.

A general formula of the dynamic Gamma curve G(x) is still in the form of a power function when $0<x\le 1$, thus conforming to the perception rule of human eyes on brightness. Furthermore, the dynamic Gamma curve customized according to the light fixture is more proper and natural than the original Gamma curve.

According to some embodiments, the original initial brightness level $n_0$ and the original refresh rate $f_0$ of the light fixture are acquired according to the following method:

- setting the Gamma curve of the light fixture as the original Gamma curve $G_0(x)$;
- adjusting the light fixture of which the Gamma curve is the original Gamma curve to the initial brightness state.
- acquiring the original refresh rate $f_0$ of the light fixture with the original Gamma curve in the initial brightness state;
- acquiring the original initial brightness level $n_0$ of the light fixture with the original Gamma curve in the initial brightness state.

In the embodiments, preferably, there are various method for acquiring the original initial brightness level $n_0$ of the light fixture with the original Gamma curve in the initial brightness state.

Due to errors of industrial manufacturing, different light fixtures in the same model may have a slight difference, thus, when the original initial brightness level $n_0$ is acquired, it needs to reduce the errors. As one embodiment, by testing a plurality of light fixtures, the original initial brightness level $n_0$ is acquired. The method of acquiring the original initial brightness level $n_0$ of the light fixture specifically comprises:

- respectively setting each Gamma curve of A sets of light fixtures in the same model as the original Gamma curve $G_0(x)$;
- respectively adjusting the A sets of light fixtures of which the Gamma curve is the original Gamma curve to the initial brightness state, and acquiring an experimental initial brightness level $n_a$ of each light fixture in the initial brightness state, wherein A is ≥2, which is a positive integer;

the original initial brightness level $n_0$ is a maximum value of the acquired A sets of experimental initial brightness levels $n_a$.

Taking the maximum value of the plurality of experimental initial brightness levels $n_a$ as the original initial brightness level $n_0$, the value is accurate, and it can be guaranteed that when the brightness level of the light fixture reaches the initial brightness level, the critical duty ratio D is large enough so that the light fixture can emit light.

As another embodiment, in order to reduce a number of test light fixtures, only one light fixture may be tested, and the experimental initial brightness level $n_1$ of the light fixture obtained by testing may be directly increased by several levels. Specifically, acquiring the original initial brightness level $n_0$ of the light fixture in the present embodiment specifically comprises: adjusting the light fixture of which the Gamma curve is the original Gamma curve to the initial brightness state, and acquiring the experimental initial brightness level $n_1$ of the light fixture in the initial brightness state;

$n_0=n_1+m$, $m\geq1$, and m is a positive integer.

In the embodiment, preferably, m=3, that is, $n_0=n_1+3$.

In the embodiment, it is not needed to perform experiments on the multiple light fixtures, which is simple and fast in operation.

It can be understood that $n_a$ and $n_1$ are both positive integers.

Before adjusting the light fixture of which the Gamma curve is the original Gamma curve to the initial brightness state, the method further comprises: placing the light fixture in a dark room.

By placing the light fixture in the dark room, the initial brightness state of the light fixture can be determined more accurately, so that the subsequently obtained original initial brightness level $n_0$ is more accurate.

In a preferred embodiment, the original Gamma value $\gamma_0$ ranges from 2.0 to 2.4, and preferably, the current Gamma value $\gamma$ ranges from 2.0 to 2.4.

In a preferred embodiment, the original Gamma value $\gamma_0$ may be 2.0 or 2.2 or 2.4, etc. the current Gamma value $\gamma$ may be 2.0 or 2.2 or 2.4, etc. and the maximum brightness level N of the light fixture may be 100 or 255 or 65535, etc.

In the embodiment, preferably, the light fixture includes an LED light source.

Embodiment 2

A system for fixing an initial brightness level of light fixtures is further provided according to one embodiment, including:

an adjusting module for performing Gamma correction on the light fixture based on a dynamic Gamma curve, the dynamic Gamma curve is as follows:

$$G(x)=\begin{cases}0 & (x=0)\\ (1-b)x^{\gamma}+b & (0<x\leq1,\ 0<b<1)\end{cases};$$

wherein, G(x) is a Gamma curve, x=n/N, n is a current brightness level set by a user, N is a maximum brightness level of the light fixture, $\gamma$ is a current Gamma value set by the user, and b is a current initial brightness PWM threshold.

The current initial brightness PWM threshold b is specifically as follows:

$$b=G_0(x)\cdot\frac{f}{f_0}\ (0\leq x\leq1);$$

wherein, $G_0(x)$ is a function of an original Gamma curve of the light fixture, $x=n_0/N$, no is an original initial brightness level of the light fixture, N is the maximum brightness level of the light fixture, $f_0$ is an original refresh rate when the light fixture adopts the original Gamma curve $G_0(x)$, and f is a current refresh rate set by the user.

The function of the original Gamma curve of the light fixture is set to be $G_0(x)=x^{\gamma_0}$, $(0\leq x\leq1)$, wherein $\gamma_0$ is an original Gamma value set by the user.

Preferably, the original Gamma value $\gamma_0$ ranges from 2.0 to 2.4.

The original initial brightness level $n_0$ and the original refresh rate $f_0$ of the light fixture are acquired by the following method:

setting the Gamma curve of the light fixture as the original Gamma curve $G_0(x)$;

adjusting the light fixture of which the Gamma curve is the original Gamma curve to an initial brightness state;

acquiring the original refresh rate $f_0$ of the light fixture with the original Gamma curve in the initial brightness state;

acquiring the original initial brightness level $n_0$ of the light fixture with the original Gamma curve in the initial brightness state.

As one embodiment, the method of acquiring the original initial brightness level $n_0$ of the light fixture specifically comprises:

respectively setting each Gamma curve of A sets of light fixtures in the same model as the original Gamma curve $G_0(x)$;

respectively adjusting the A sets of light fixtures of which the Gamma curve is the original Gamma curve to the initial brightness state, and acquiring an experimental initial brightness level $n_a$ of each light fixture in the initial brightness state, wherein A is $\geq2$, which is a positive integer;

the original initial brightness level $n_0$ is a maximum value of the acquired A sets of experimental initial brightness levels $n_a$.

As another embodiment of the embodiment, the method of acquiring the original initial brightness level $n_0$ of the light fixture specifically comprises:

adjusting the light fixture of which the Gamma curve is the original Gamma curve to the initial brightness state, and acquiring an experimental initial brightness level $n_1$ of the light fixture in the initial brightness state:

$n_0=n_1+m$, $m\geq1$, and m is a positive integer.

Before adjusting the light fixture of which the Gamma curve is the original Gamma curve to the initial brightness state, the light fixture is placed in a dark room.

Preferably, the original Gamma value $\gamma$ ranges from 2.0 to 2.4.

Embodiment 3

A computer-readable storage medium, on which a computer program is stored, is further provided, and when the computer program is executed by a processor, the method for fixing the initial brightness level of the light fixture according to Embodiment 1 is implemented.

Embodiment 4

Figure 5:
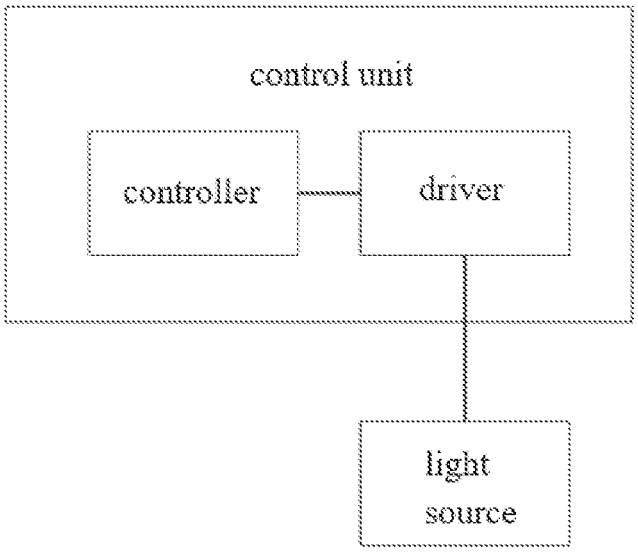
FIG. 5 is a structural diagram of a light fixture system according to the present invention.

As shown in FIG. 5, the present embodiment provides a light fixture system, including a light source and a control unit connected to each other. The dynamic Gamma curve according to Embodiment 1 is pre-set in the control unit.

The control unit is configured to receive a current brightness level input by a user, and outputs a current PWM duty ratio corresponding to the current brightness level to the light source according to the dynamic Gamma curve, so that the light source emits light according to the current PWM duty ratio.

In a preferred embodiment, the control unit may include a controller and a driver connected to each other, and the driver is further connected to the light source. When the light fixture system works, the controller receives the current brightness level input by the user, and outputs the current PWM duty ratio corresponding to the current brightness level to the driver according to the dynamic Gamma curve, so that the driver controls the light source to emit light according to the current PWM duty ratio.

Obviously, the above-mentioned embodiments of the present invention are merely embodiments to clearly illustrate the technical solution of the present invention, and are not intended to limit the specific embodiment of the present invention. Any modification, equivalent replacement, improvement and the like made within the spirit and principle of the claims of the present invention shall be included in the protection scope of the claims of the present invention.

The invention claimed is:

1. A method for fixing an initial brightness level of a light fixture, comprising steps of: performing a Gamma correction on the light fixture based on a dynamic Gamma curve, wherein the dynamic Gamma curve is $$G(x) = \begin{cases} 0 & (x = 0) \\ (1-b)x^{\gamma} + b & (0 < x \le 1, 0 < b < 1) \end{cases};$$

in which, G(x) is the dynamic Gamma curve, x=n/N, n is a current brightness level set by a user, N is a maximum brightness level of the light fixture, $\gamma$ is a current Gamma value set by the user, and b is a current initial brightness PWM threshold.

2. The method according to claim 1, wherein the current initial brightness PWM threshold b is:

$$b = G_0(x) \cdot \frac{f}{f_0} \quad (0 \le x \le 1);$$

in which, $G_0(x)$ is a function of an original Gamma curve of the light fixture, $x=n_0/N$, $n_0$ is an original initial brightness level of the light fixture, N is the maximum brightness level of the light fixture, $f_0$ is an original refresh rate when the light fixture adopts the original Gamma curve $G_0(x)$, and f is a current refresh rate set by the user.

3. The method according to claim 2, wherein, the function of the original Gamma curve of the light fixture is set to be $G_0(x)=x^{\gamma_0}$, $(0 \le x \le 1)$, wherein $\gamma_0$ is an original Gamma value set by the user.

4. The method according to claim 3, wherein the original Gamma value $\gamma_0$ ranges from 2.0 to 2.4.

5. The method according to claim 2, wherein the original initial brightness level $n_0$ and the original refresh rate $f_0$ of the light fixture are acquired by the following method:

setting the Gamma curve of the light fixture as the original Gamma curve $G_0(x)$;

adjusting the light fixture of which the Gamma curve is the original Gamma curve to an initial brightness state;

acquiring the original refresh rate $f_0$ of the light fixture with the original Gamma curve in the initial brightness state; and acquiring the original initial brightness level $n_0$ of the light fixture with the original Gamma curve in the initial brightness state.

6. The method according to claim 5, wherein, before adjusting the light fixture of which the Gamma curve is the original Gamma curve to the initial brightness state, the method further comprises:

placing the light fixture in a dark room.

7. The method according to claim 5, wherein, the method of acquiring the original initial brightness level $n_0$ of the light fixture comprises:

respectively setting each Gamma curve of A sets of light fixtures in the same model as the original Gamma curve $G_0(x)$;

respectively adjusting A sets of light fixtures of which the Gamma curve is the original Gamma curve to the initial brightness state, and acquiring an experimental initial brightness level $n_a$ of each light fixture in the initial brightness state, wherein a is ≥2, which is a positive integer; and the original initial brightness level $n_0$ is a maximum value of the acquired A sets of experimental initial brightness levels $n_a$.

8. The method according to claim 7, wherein, before adjusting the light fixture of which the Gamma curve is the original Gamma curve to the initial brightness state, the method further comprises:

placing the light fixture in a dark room.

9. The method according to claim 1, wherein the current Gamma value $\gamma$ ranges from 2.0 to 2.4.

10. A system for fixing an initial brightness level of a light fixture, comprising:

an adjusting module for performing Gamma correction on the light fixture based on a dynamic Gamma curve, wherein the dynamic Gamma curve is $$G(x) = \begin{cases} 0 & (x = 0) \\ (1-b)x^{\gamma} + b & (0 < x \le 1, 0 < b < 1) \end{cases};$$

in which, G(x) is the dynamic Gamma curve, x=n/N, n is a current brightness level set by a user, N is a maximum brightness level of the light fixture, $\gamma$ is a current Gamma value set by the user, and b is a current initial brightness PWM threshold.

11. A light fixture system, comprising a light source and a control unit connected to each other, wherein the dynamic Gamma curve according to claim 1 is pre-set in the control unit, and the control unit is configured to receive a current brightness level input by a user, and output a current PWM duty ratio corresponding to the current brightness level to the light source according to the dynamic Gamma curve, so that the light source emits light according to the current PWM duty ratio.

* * * * *